US006248192B1

(12) United States Patent
Quick et al.

(10) Patent No.: US 6,248,192 B1
(45) Date of Patent: Jun. 19, 2001

(54) PROCESS FOR MAKING AN ALLOY

(75) Inventors: Nathaniel R. Quick, Lake Mary; Michael Liberman; Alexander Sobolevsky, both of Deland, all of FL (US)

(73) Assignee: USF Filtration and Separations Group, Inc, Timonium, MD (US)

( * ) Notice: Subject to any disclaimer, the term of this patent is extended or adjusted under 35 U.S.C. 154(b) by 0 days.

(21) Appl. No.: 09/307,101

(22) Filed: May 7, 1999

Related U.S. Application Data

(60) Provisional application No. 60/084,688, filed on May 8, 1998.

(51) Int. Cl.[7] ..... C22F 1/10

(52) U.S. Cl. ..... 148/676; 420/590; 148/519; 428/680

(58) Field of Search ..... 420/590; 148/519, 148/676; 428/680

(56) References Cited

U.S. PATENT DOCUMENTS

| | | | | |
|---|---|---|---|---|
| 3,785,036 | * | 1/1974 | Tada et al. | 29/419 |
| 3,818,578 | * | 6/1974 | Raymond et al. | 29/527.5 |
| 5,223,748 | * | 6/1993 | Whitlow | 505/1 |
| 5,454,163 | * | 10/1995 | McDonald et al. | 29/840.32 |
| 5,525,423 | * | 6/1996 | Liberman et al. | 428/370 |
| 5,628,835 | * | 5/1997 | Tada et al. | 148/98 |
| 5,774,779 | * | 6/1998 | Tuchinskiy | 419/2 |
| 5,890,272 | * | 4/1999 | Liberman et al. | 29/419.1 |
| 5,935,911 | * | 8/1999 | Yamada et al. | 505/230 |

* cited by examiner

*Primary Examiner*—Roy King
*Assistant Examiner*—Nicole Coy
(74) *Attorney, Agent, or Firm*—Frijouf, Rust & Pyle, P.A.

(57) ABSTRACT

A process is disclosed for making an alloy comprising the steps of cladding with a tube a plurality of metal members including a first and a second metal to form a metal composite. The metal composite is drawn for reducing the diameter thereof. The tube is removed to provide a remainder. The remainder is heated to convert the remainder to alloy. A multiplicity of composites may be processed simultaneously for producing fine alloy fibers.

18 Claims, 12 Drawing Sheets

PROCESS FOR MAKING AN ALLOY

CROSS-REFERENCE TO RELATED APPLICATIONS

This application claims benefit of United States Patent Provisional application Ser. No. 60/084,688 filed May 8, 1998. All subject matter set forth in provisional application Ser. No. 60/084,688 is hereby incorporated by reference into the present application as if fully set forth herein.

BACKGROUND OF THE INVENTION

1. Field of the Invention

This invention pertains to a method of preparing alloys. More specifically, the method involves cladding a number of different types of metallic wires in a tubing, drawing the tubing/wires to reduce the diameter thereof, removing the tubing, and heating the remainder so as to form an alloy.

2. Background of the Invention

Various alloys have been studied and utilized in structural materials over pure metals due to the high melting temperature, hardness, and chemical stability of certain alloys. Numerous alloys hold great promise, but are limited by low ductility and low-temperature brittleness. Obtaining these low ductility alloys in wire form is a costly proposition, as once the alloy is formed, is can not we drawn down to wire form.

Alloys are typically formed by powder metallurgy methods or by melt processing of stoichiometric single crystals. Neither of these methods allows for the easy formation of alloy wire, especially where the alloy in demand is of low ductility.

This invention provides a new process for forming wire alloy products from wire precursors. The process involves cladding a number of metallic wires with a tubing to form a composite. At least two types of metal wires are used. The composite is then drawn, stripped of its tubing, and heated so that an alloy forms from the metal precursors. The alloy composition will depend on the composition of the wire precursors.

The present invention is especially useful in that it allows the formation of alloys with normally low ductility into wire form with unexpectedly high ductility.

Nickel aluminides are one type of alloy which can be made by the present invention. Nickel aluminides are intermetallic materials that have long been considered potentially useful due to their strength, hardness, and high melting points. Nickel aluminides are very strong, namely five times as strong as stainless steel. At the same time, alloys are relatively light metals. Standard alloys have a disordered structure that becomes even more random and weaker with increasing temperatures. Nickel aluminides on the other hand, with an ordered structure, becomes stronger with increasing temperature to about 800° C. At high temperatures, they are resistant to wear, deformation, fatigue, and therefore cracking. But nickel aluminides are generally too brittle to be shaped into wire components.

It is therefore an object of the present invention to provide a process for making an alloy in wire form from wire precursors.

It is therefore an object of the present invention to provide a process for making an alloy in a fine fiber form.

It is further an object of the present invention to provide a process for making a wire alloys with unexpectedly high ductilities.

It is further an object of the present invention to provide a process for making an alloy that is economical to manufacture.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention within the scope of the invention. Accordingly other objects in a full understanding of the invention may be had by referring to the summary of the invention and the detailed description setting forth the preferred embodiment in addition to the scope of the invention defined by the claims taken in conjunction with the accompanying drawings.

SUMMARY OF THE INVENTION

Disclosed is a process for making an alloy. The process comprises cladding with a tube a plurality of metal members to form a metal composite. The metal members include a first and second metal. The metal composite is then drawn to reduce its diameter, and the tubing is then removed from the composite to leave a remainder. The remainder is then heated to convert the metals in the remainder to alloy.

One embodiment involves providing a plurality of first and second metal members comprised of first and second metals respectively and twisting the plurality of metal members into a twisted assembly. A plurality of these assemblies are then jacketed with a composite tube so as to form the metal composite.

In another embodiment, the plurality of metal members is comprised of nickel and aluminum, and each individual metal member is comprised of either nickel or aluminum. The nickel to aluminum weight percentage ration may be 75:25.

The plurality of metal members can be comprised of at least three metals, each individual member being comprised of a single metal. In this embodiment, the plurality of metal members is comprised of aluminum and nickel, and the third metal is selected from the group of metals consisting of boron, chromium, titanium, platinum, and iron.

In a preferred embodiment, the tube cladding the plurality of metal members is comprised of stainless steel.

Another embodiment of the present invention provides a process for making an alloy wherein the first step involves cladding a plurality of metal wires with a plurality of tubings to form a plurality of metal members. The wires are comprised of a first metal, and the tubings of a second. The plurality of metal members are then jacketed with a second tubing to provide a metal composite. The composite is drawn to reduce its diameter, and the second tubing is removed to leave a remainder. The remainder is then heated so as to convert the remainder to an alloy of the first and second metal. Either the metal wires or the metal member first tubings can be comprised of Ni and the other of Al; further the second tubing can be comprised of carbon steel.

Another embodiment provides for a process for making an alloy comprising cladding a plurality of metal wires comprised of a first metal with a plurality of first tubings. The plurality of first tubings comprise a second metal to form a plurality of metal members. Each of the metal member is clad with a second tubing to form a plurality of coated metal members. The coated metal members were drawn to reduce the diameter thereof. The plurality of coated metal members are clad with a third tubing to provide a metal composite. The metal composite is drawn to reduce the diameter thereof. The second and third tubings are removed to provide a metallic remainder comprising the metallic first tubing cladding material with the metallic wire material. The metallic remainder is heated to convert the metallic remainder to alloy. In this embodiment, the alloy product can be fibrous.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated that the conception and the specific embodiments disclosed may be readily utilized as a basis for modifying or designing other structures for carrying out the same purposes of the present invention. It also should be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

DETAILED DISCUSSION

The present invention is unique in that it provides a new method for creating alloys, and more specifically provides a new method for creating alloys with high ductility that by other methods would have a low ductility.

Figure 1:
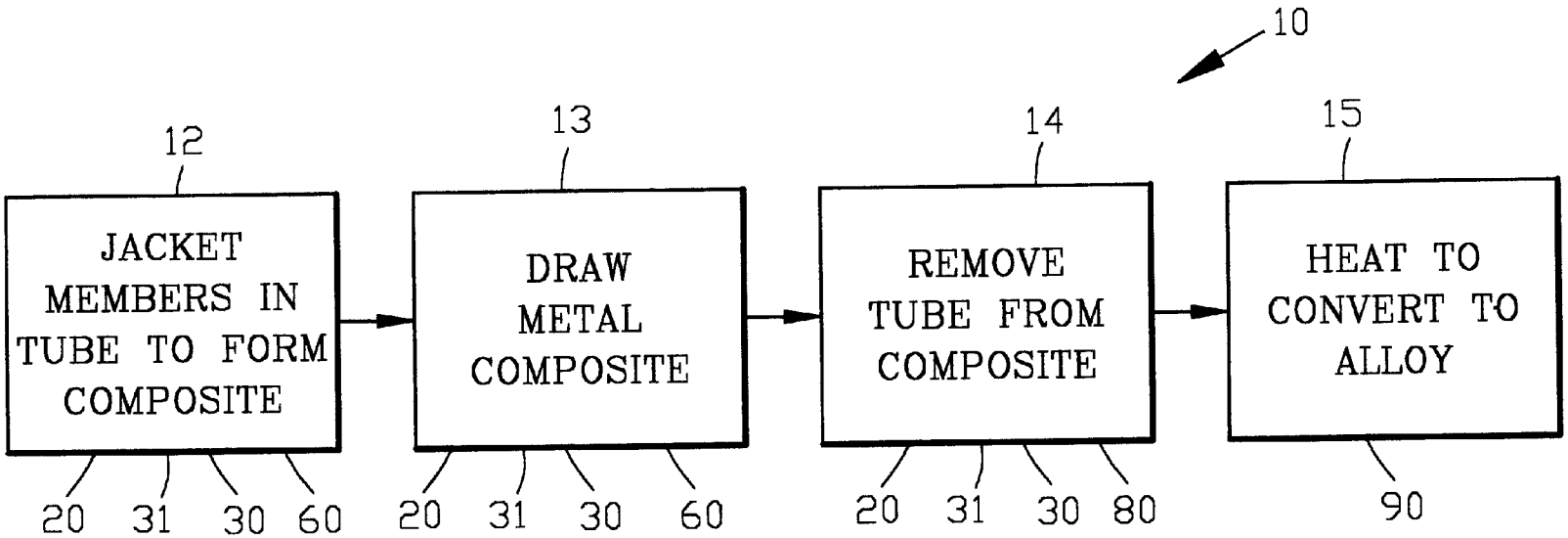
FIG. 1 is a block diagram illustrating a general process 10 for creating an alloy.

FIG. 1 is a block diagram illustrating a general process 10 for creating an alloy. The process 10 of FIG. 1 comprises cladding a plurality of at least two types of metal members with a tube. Each metal member, can have any number take a number of forms, including a metal wire form, a metal coated wire form, a multiple coated wire form, a drawn metal coated wire form, or a drawn multiple coated wire form. The metal members may have varied diameters. The at least two types of metal members are comprised of different metals. A plurality of metal members are jacketed with tubing to form a metal composite. This metal composite is then drawn to reduce the diameter of the composite. The tube and optionally any number of the metal coatings are then removed, physically and/or chemically, and the remainder is then heated to convert the remainder to alloy.

In a first general embodiment of the present invention, the metal members are comprised of a wire that is jacketed by a tubing, and a plurality of these metal members are then jacketed by a second tubing to form a metal composite.

Figure 2:
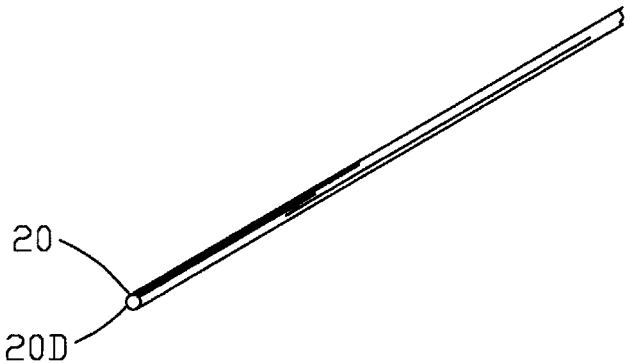
FIG. 2 is an isometric view of a metal wire.
Figure 2A:
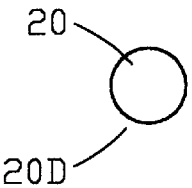
FIG. 2A is an enlarged cross sectional view of FIG. 2.

FIG. 2 is an isometric view of a metal wire 20, with FIG. 2A being an enlarged cross sectional view of FIG. 2. The metal wire has a diameter 20D.

Preferably, the wire is made of a metal selected from the group of aluminum, nickel, iron, and titanium, although any metal wire may be used. The wire may be comprised of an alloy. In one preferred embodiment, the wire is comprised of an aluminum boron alloy, or a nickel chromium alloy.

Figure 3:
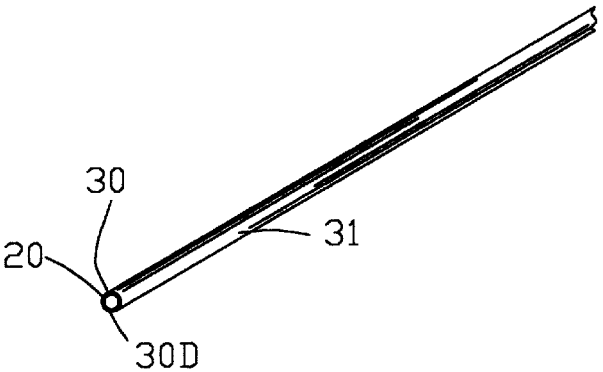
FIG. 3 is an isometric view of the metal wire referred to in FIG. 2 encased in a tube to thereby form a metal member.
Figure 3A:
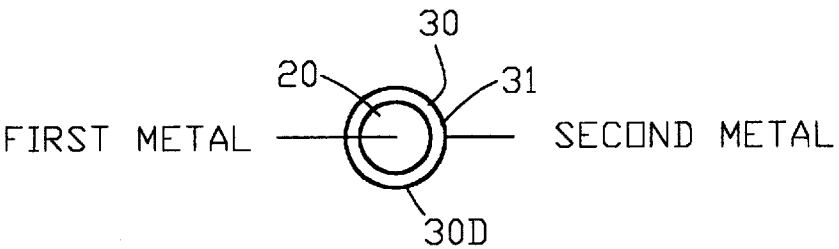
FIG. 3A is an enlarged cross-sectional view of FIG. 3.

FIG. 3 is an isometric view of the metal wire 20 referred to in FIG. 2 encased in a tube 30 to thereby form a metal member 31 referred to in FIG. 1. The tube 30 is comprised of a different metal than the metal wire 20. Preferably, the tubing is comprised of a metal selected from the group of aluminum, nickel, iron and titanium although any metal can be used. The tube 30 may be comprised of an alloy. In a preferred embodiment, the alloy is selected from a nickel-chromium alloy or an aluminum-boron alloy. The tube 30 has an outer diameter 30D. FIG. 3A is an enlarged cross-sectional view of FIG. 3.

Figure 4:
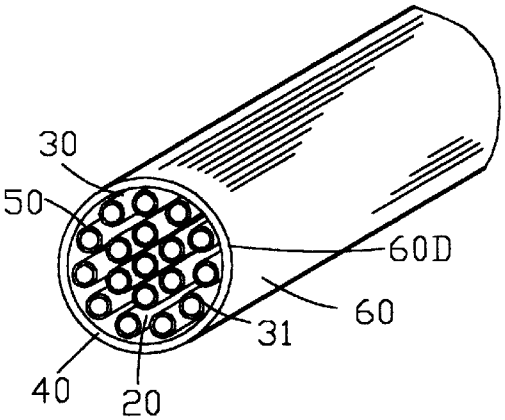
FIG. 4 is an isometric view of a plurality of metal members jacketed or inserted within a composite tube.
Figure 4A:
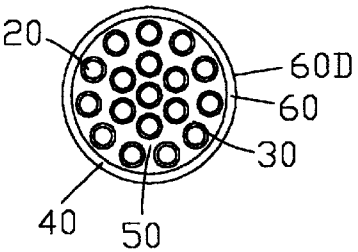
FIG. 4A is a cross sectional view of FIG. 4.

FIG. 1 illustrates the process step 12 of cladding a plurality of metal members 20 with a tube 40. FIG. 4 is an isometric view of a plurality of metal members 20 jacketed or inserted within a composite tube 40 with FIG. 4A being a cross sectional view of FIG. 4. In this embodiment of the invention, the composite tube 40 is a preformed tube. Preferably, the preformed composite tube 40 is made of a carbon steel material.

The plurality of metal members 31 are assembled in an array 50. The array 50 of the plurality of metal members 31 are jacketed within the tube 40 for providing a metal composite 60 having a diameter 60D.

Although the composite tube 40 is disclosed as a preformed carbon steel tube, the array 50 of the plurality of metal members 20 may be encased within the tube 40 through a conventional cladding process. Preferably, approximately one thousand (1000) metallic members 31 are inserted within the composite tube 40.

FIG. 1 illustrates the process step 13 of drawing the metal composite 60. The process step 13 of drawing the metal composite 60 provides three effects. Firstly, the process step 13 reduces an outer diameter 60D of the metal composite 60. Secondly, the process step 13 reduces the corresponding outer diameter 20D of each of the plurality of metal wires 20 and the corresponding outer diameter 30D of each of the wire tubings 30. Thirdly, the process step 13 causes the coating materials 30 on each of metal wires 20 to diffusion weld with the tubings 30 cladding adjacent metallic wires 20.

The drawing procedure may by performed more than once to draw the metal composite down to a desired diameter. This is necessary to control the amount of heat generated in the drawing process, which could prematurely cause the wire and tubing metals to react to form an alloy.

Figure 5:
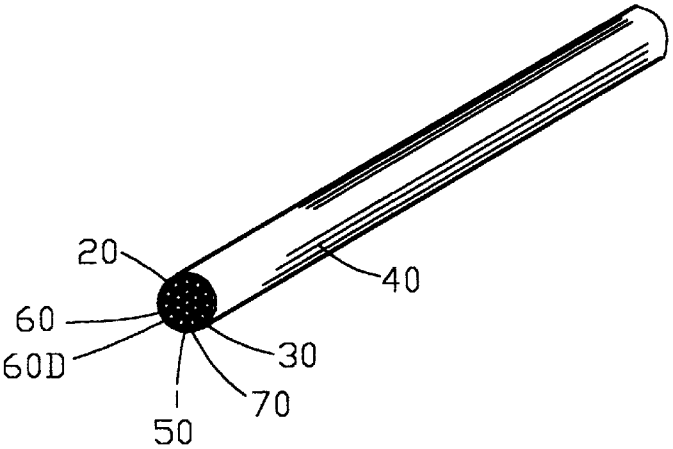
FIG. 5 is an isometric view of the plurality of the metal members inserted within the preformed tube after the process step of drawing the metal composite.
Figure 5A:
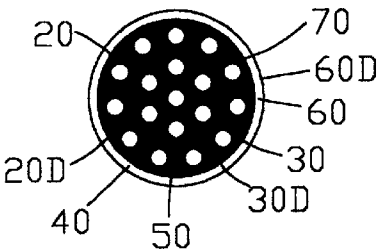
FIG. 5A is an enlarged end view of FIG. 5.

FIG. 5 is an isometric view of the plurality of the metal members 31 inserted within the preformed tube 40 after the process step 13 of drawing the metal composite 60. FIG. 5A is an enlarged end view of FIG. 5. Drawing the metal composite 60 causes the tubing 30 on each metal wire 20 to diffusion weld with the tubing 30 on adjacent metal wires 20. The diffusion welding of the cladding tubings 30 on adjacent metal wires 20 forms a unitary cladding material 70 that extends throughout the interior of the metal composite 60. The plurality of metal wires 20 are contained within the unitary cladding material 70 extending throughout the interior of the metal composite 60.

FIG. 1 illustrates the process step 14 of removing the composite tube 40. In the preferred form of the process, the step 14 of removing the composite tube 40 comprises mechanically removing the composite tube 40.

Figure 6:
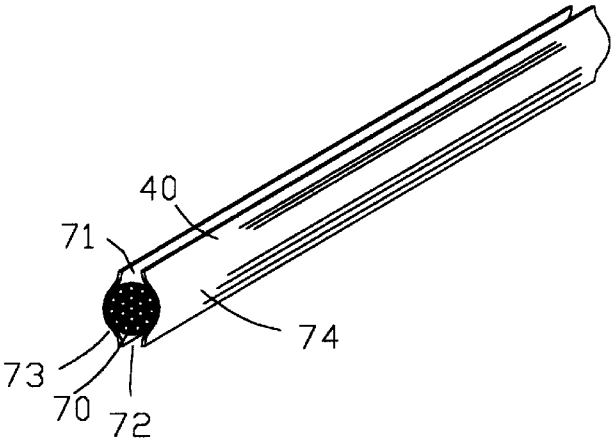
FIG. 6 is an isometric view illustrating the mechanical removal of the preformed composite tube.
Figure 6A:
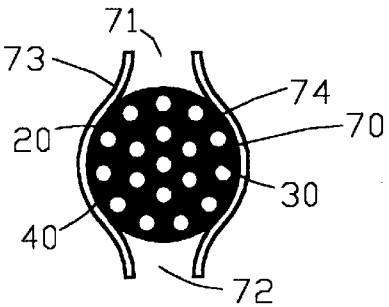
FIG. 6A is an enlarged end view of FIG. 6.

FIG. 6 is an isometric view illustrating the mechanical removal of the preformed composite tube 40 with FIG. 6A being an enlarged end view of FIG. 6. In one example of this process step 14, the composite tube 40 is scored or cut at 71 and 72 by mechanical scorers or cutters (not shown). The scores or cuts at 71 and 72 form composite tube portions 73 and 74 that are mechanically pulled apart to peel the composite tube 40 off of the metal composite 60 to leave a remainder 80. Alternatively, the composite tube can be chemically removed from the composite to leave a remainder 80.

FIG. 1 illustrates the process step 15 of heating the composite tube 40 minus the composite tubing 40 to convert the remainder to alloy. In the preferred form of the process, the remainder 80 is heated to a temperature in the range of 1000° C.–1300° C. step 15 so as to convert the metal remainder 80 to an alloy.

Figure 7:
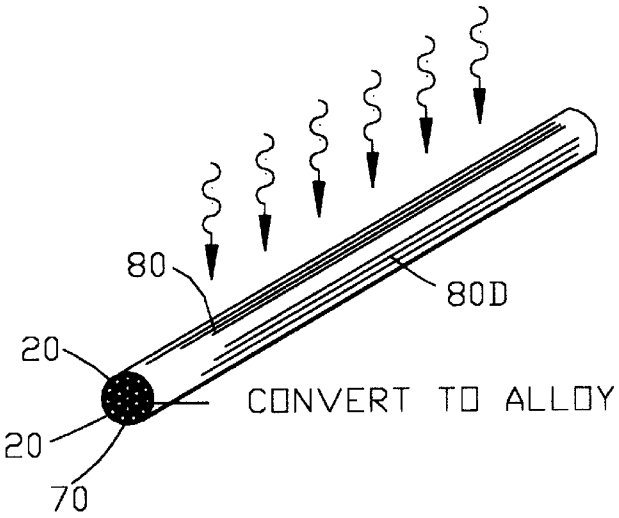
FIG. 7 is an isometric view illustrating the remainder upon complete removal of the tube.

FIG. 7 is an isometric view illustrating the remainder 80 upon complete removal of the tube 40. The remainder 80 comprises substantially unitary cladding material 70 with the plurality of metallic wires 20 contained therein. The remainder 80 defines an outer diameter 80D. The spiraling arrows represent the general application of heat to the remainder 80. As heat is applied to the remainder 80, the metals of the unitary cladding material and the metal wires combine to form a new metal alloy 90.

Figure 7A:
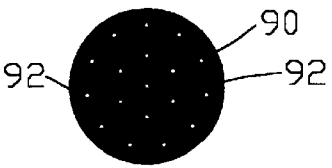
FIG. 7A is an enlarged cross sectional view of the alloy product of the heated remainder of FIG. 7.

FIG. 7A is an enlarged cross sectional view of the alloy product 90 of the heated remainder 80 of FIG. 7. The alloy 90 is a single strand product. The product has a high ductility.

In a preferred embodiment, the alloy is $Ni_3Al$. In this embodiment, the metal wire diameter and composite tubing thickness (one comprised of nickel and the other of aluminum) are chosen so that the final product contains seventy-five atomic percent Ni and twenty-five atomic percent Al. The reactants must have roughly 86.7% by weight nickel and 13.3% by weight aluminum. The alloy product has a number of randomly oriented pores 92 which can be attributed to the lower density of $Ni_3Al$ in comparison to the densities of nickel or aluminum alone. The product has a high ductility for an alloy of normally low ductility.

In another embodiment, the alloy product is NiAl. In this embodiment, the metal wire diameter and composite tubing thickness are chosen so that the final product contains fifty atomic percent Ni and fifty atomic percent Al.

In yet another embodiment, the alloy product is $Fe_3Al$. The metal wire diameter and composite tubing thickness (one comprised of iron and the other of aluminum) are chosen so that the final product contains seventy-five atomic percent Fe and twenty-five atomic percent Al.

In another embodiment, the alloy product is FeAl. In this embodiment, the metal wire diameter and composite tubing thickness are chosen so that the final product contains fifty atomic percent Fe and fifty atomic percent Al.

Figure 8:
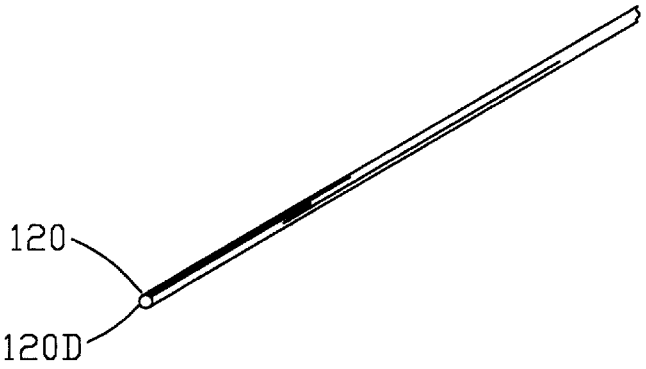
FIG. 8 is an isometric view of a metal wire.
Figure 8A:
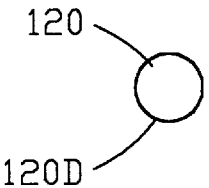
FIG. 8A is an enlarged cross sectional view of FIG. 8.

FIG. 8 is an isometric view of a metal wire 120, with FIG. 8A being an enlarged cross sectional view of FIG. 8. Preferably, the wire is made of a metal selected from the group of aluminum, nickel, chromium, iron, stainless steel, titanium, platinum, and boron, although any metal wire may be used. The wire may be comprised of an alloy. In a preferred embodiment, the wire is comprised of an aluminum boron alloy, or a nickel chromium alloy. The metal wire has a diameter 120D.

Figure 9:
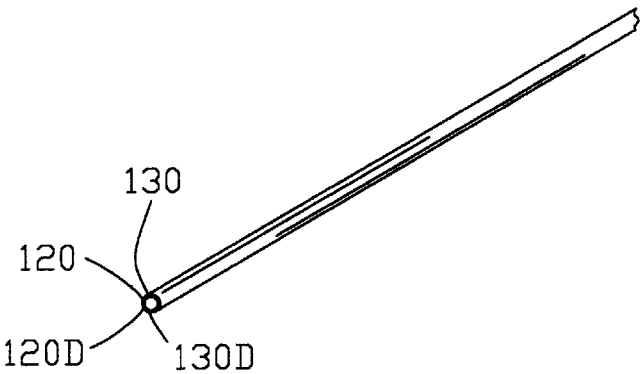
FIG. 9 is an isometric view of the metal wire referred to in FIG. 8 encased in a tube to thereby form a metal member.
Figure 9A:
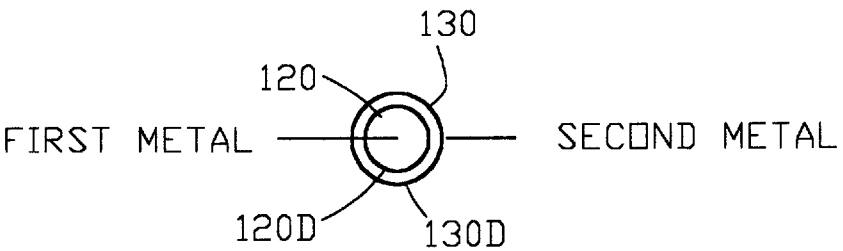
FIG. 9A is an enlarged cross-sectional view of FIG. 9.

FIG. 9 is an isometric view of the metal wire 120 referred to in FIG. 8 encased in a tube 130 to thereby form a metal member 131. The tube 130 is comprised of a different metal than the metal wire 120. Preferably, the tubing 131 is comprised of a metal selected from the group of aluminum, nickel, iron and titanium, although any metal can be used. The tube 130 may be comprised of an alloy. In a preferred embodiment, the alloy is selected from a nickel-chromium alloy or an aluminum-boron alloy. The tube 130 has an outer diameter 130D. FIG. 9A is an enlarged cross-sectional view of FIG. 9.

Figure 10:
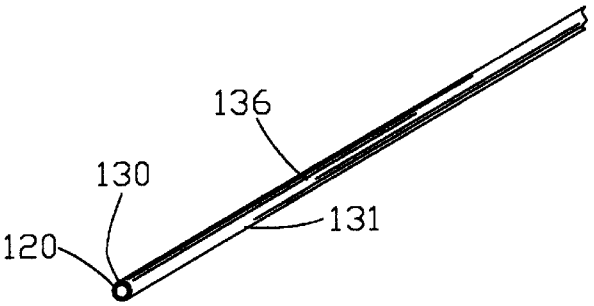
FIG. 10 is an isometric view of the metal member referred to in FIG. 9 encased in a member coating tube to thereby form a coated metal member.
Figure 10A:
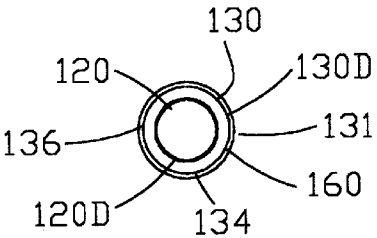
FIG. 10A is an enlarged cross-sectional view of FIG. 10.

FIG. 10 is an isometric view of the metal member 131 referred to in FIG. 9 encased in a member coating tube 134 to thereby form a coated metal member 136. FIG. 10A is an enlarged cross-sectional view of FIG. 10. The member coating tube 134 is comprised of a different metal than the tubing that jackets the metal wires 130. Preferably, the tubing 134 is made of carbon steel. Alternatively, the member coating tube 134 is comprised of a metal selected from the group of aluminum, nickel, iron and titanium, although any metal can be used. The tube 134 may be comprised of an alloy. In a preferred embodiment, the alloy is selected from a nickel-chromium alloy or an aluminum-boron alloy. The tube 134 has an outer diameter 134D.

Figure 11:
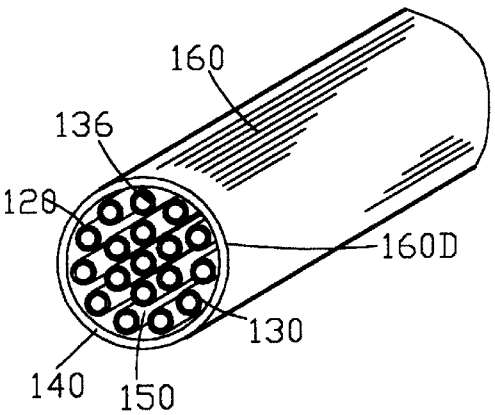
FIG. 11 is an isometric view of a plurality of coated metal members jacketed or inserted within a composite tube.
Figure 11A:
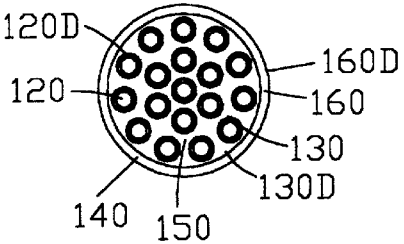
FIG. 11A is a cross sectional view of FIG. 11.

FIG. 1 illustrates the process step 12 of cladding a plurality of metal members with a tube. However, in this embodiment, a plurality of coated metal members 136 are jacketed with a tube to form a metal composite 160. FIG. 11 is an isometric view of a plurality of coated metal members 136 jacketed or inserted within a composite tube 140 with FIG. 11A being a cross sectional view of FIG. 11. In the diagramed embodiment of the invention, the composite tube 140 is a preformed tube. Preferably, the preformed composite tube 140 is made of a carbon steel material.

The plurality of coated metal members 136 are assembled in an array 150. The array 150 of the plurality of coated metal members 136 are jacketed within the tube 140 for providing a metal composite 160 having a diameter 160D.

Although the composite tube 140 is disclosed as a preformed carbon steel tube, the array 150 of the plurality of coated metal members 136 may be encased within the tube 140 through a conventional cladding process. Preferably, approximately one thousand (1000) coated metallic members 136 are inserted within the composite tube 140.

FIG. 1 illustrates the process step 13 of drawing the metal composite. The process step 13 of drawing the metal composite 160 provides three effects. Firstly, the process step 13 reduces an outer diameter 160D of the metal composite 160. Secondly, the process step 13 reduces the corresponding outer diameter 120D of each of the plurality of metal wires 120 and the corresponding outer diameter 130D, 134D of each of the wire coating tubings 130, 134. Thirdly, the process step 13 causes the member coating tube 134 materials on each of the coated metal members 136 to diffusion weld with the tubing 134 material of adjacent coated metal members 136.

The drawing procedure may by performed more than once to draw the metal composite down to a desired diameter. This is necessary to control the amount of heat generated in the drawing process, which could prematurely cause the wire and tubing metals to react to form an alloy.

Figure 12:
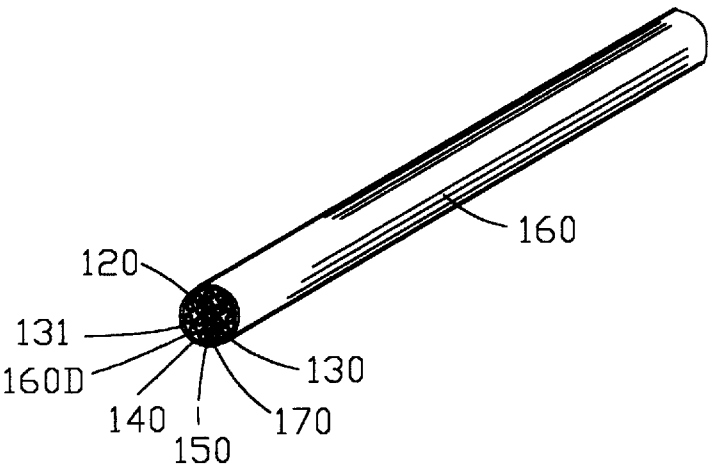
FIG. 12 is an isometric view of the plurality of the coated metal members inserted within the preformed composite tube after the process step of drawing the metal composite.
Figure 12A:
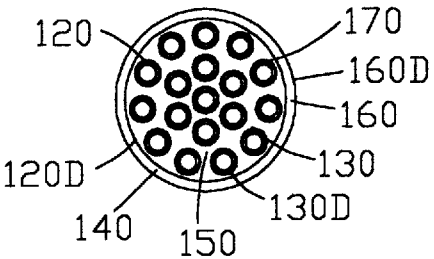
FIG. 12A is an enlarged end view of FIG. 12.

FIG. 12 is an isometric view of the plurality of the coated metal members 136 inserted within the preformed composite tube 140 after the process step 13 of drawing the metal composite 160. FIG. 12A is an enlarged end view of FIG. 12.

FIG. 1 illustrates the process step 14 of removing the composite tube. In the preferred form of the process, the step 14 of removing the composite tube comprises mechanically removing the composite tube. In the present embodiment, where a plurality of wires is double jacketed prior to being jacketed into a metal composite, the composite tubing 140 may be removed either mechanically or chemically, as described above, thereby leaving a remainder 180.

In a preferred embodiment, both the composite tubing 140 and the member coating tubing 134 is comprised of carbon steel, and ultimately both components are removed from the remainder 180. In this embodiment, the composite tubing 140 can be removed either mechanically or chemically, but the coated member tubing must be removed chemically. It is preferred that both be removed chemically. Where a metal utilized in a wire 120, tubing 130, or member coating tubing 134 is leached out, the drawn composite can be cut in segments to increase the efficiency of the chemical leaching process.

Figure 13:
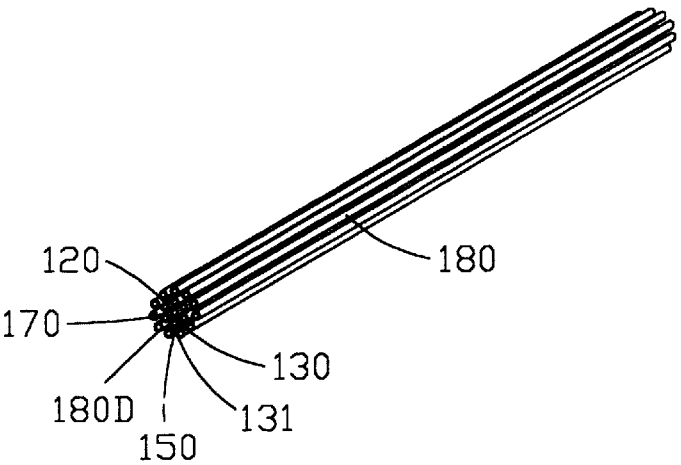
FIG. 13 is an isometric view of a remainder after the member coating the tubing and composite tubing have been removed.
Figure 13A:
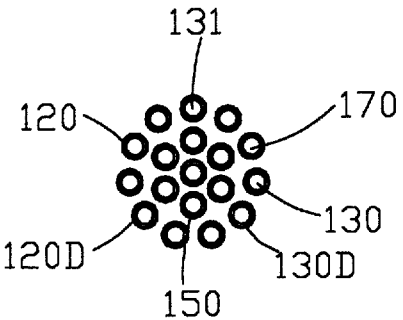
FIG. 13A is an enlarged cross sectional view of a remainder lacking the composite tubing and coated member tubing.

In an embodiment where the member coating tubing and the composite tubing have been removed from the metal composite 160, the resulting remainder is a fibrous product, as demonstrated in FIGS. 13 and 13A. FIG. 13A is an enlarged cross sectional view of a remainder lacking the composite tubing and coated member tubing. The remainder 180 basically consists of a plurality of metal members 131 (comprised of the initial metal wire and surrounding tubing) running essentially in parallel. One manifestation of this embodiment exists where the composite tubing 140 and member coating tubing 134 are comprised of carbon steel.

FIG. 1 illustrates the process step 15 of heating the composite 140 minus the composite tubing 140 to convert the remainder to alloy. In the preferred form of the process, the remainder 180 is heated to a temperature in the range of 1000° C.–1300° C. step 15 so as to convert the metal remainder 180 to an alloy.

Figure 14:
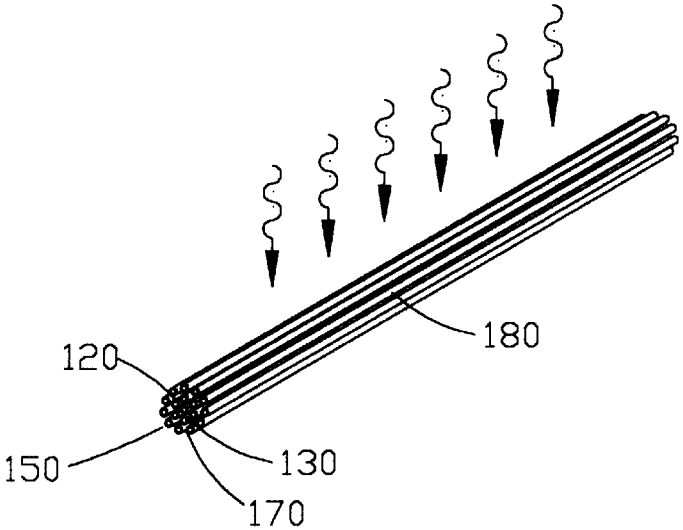
FIG. 14 is an isometric view illustrating the remainder upon complete removal of the tube.
Figure 14A:
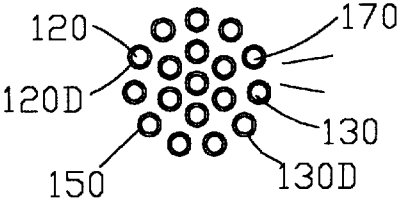
FIG. 14A is a cross sectional view of FIG. 14.

FIG. 14 is an isometric view illustrating the remainder 180 upon complete removal of the tube 40. The remainder 180 comprises substantially a plurality of tightly packed metal members 131 running substantially in parallel. The remainder 80 defines an outer diameter 80D. The spiraling arrows in FIG. 14 represent the general application of heat to the remainder 180. As heat is applied to the remainder 180, the metals in each metal member 131 (from the metal wire 120 and the tubing 130) combine to form a new metal alloy 190. FIG. 14A is a cross sectional view of FIG. 14.

Figure 15:
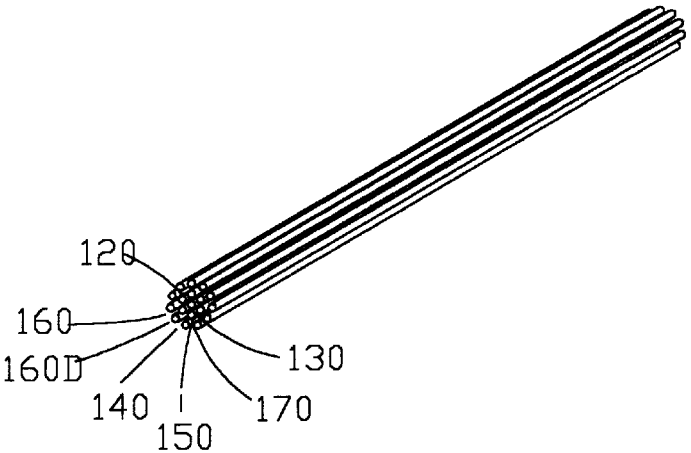
FIG. 15 is an isometric view of the alloy product of the heated remainder of FIG. 14.
Figure 15A:
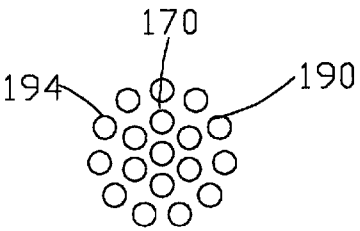
FIG. 15A is a cross sectional view of FIG. 15.

FIG. 15A is a cross sectional view of FIG. 15 and is an enlarged cross sectional view of the alloy product 190 of the heated remainder 180 of FIG. 7. The alloy 190 product is comprised of a plurality of fibers running in parallel 194. The product has a high ductility.

In a preferred embodiment, the alloy is $Ni_3Al$. In this embodiment, the metal wire diameter and composite tubing thickness (one comprised of nickel and the other of aluminum) are chosen so that the final product contains seventy-five atomic percent Ni and twenty-five atomic percent Al. The reactants must be roughly 86.7% by weight nickel and 13.3% by weight aluminum. The member coating and composite tubing, both removed either mechanically or chemically, are comprised of carbon steel. The alloy product is fibrous in nature. Each fiber has a number of randomly oriented pores which can be attributed to the lower density of $Ni_3Al$ in comparison to the densities of nickel or aluminum alone. The product has a high ductility for an alloy of normally low ductility.

In another embodiment, the alloy product is NiAl. In this embodiment, the metal wire diameter and composite tubing thickness are chosen so that the final product contains fifty atomic percent Ni and fifty atomic percent Al. Again the member coating tubing and composite tubing, both removed either mechanically or chemically, are comprised of carbon steel.

In yet another embodiment, the alloy product is $Fe_3Al$. The metal wire diameter and composite tubing thickness (one comprised of iron and the other of aluminum) are chosen so that the final product contains seventy-five atomic percent Fe and twenty-five atomic percent Al. The member coating and composite tubings are removed.

In another embodiment, the alloy product is FeAl. In this embodiment, the metal wire diameter and composite tubing thickness are chosen so that the final product contains fifty atomic percent Fe and fifty atomic percent Al. Again, the member coating and composite tubings are removed.

In a third embodiment of the present invention, a metal member is comprised of a metal wire, and a plurality of these metal wires are jacketed with a tubing to form a metal composite that is drawn, stripped of its cladding, and heated to form an alloy. A plurality of two types of wire of different composition are encased in a tube to form a metal composite. The tubing has a different metal composition than the two types of wires, although if three wire types are used, the tubing may have the same composition as one of the wire types. In a preferred embodiment, the tubing is comprised of carbon steel. After the plurality of wires are encased in the tubing, the resulting metal composite is drawn to a decreased diameter. The outer tube is then removed, either mechanically or chemically, and the remainder is heated at a temperature that will convert the remaining metal wires to an alloy. Where more than two types of wire are jacketed, one of the wire types may be removed from the composite contemporaneously or separately from the cladding tube removal.

In a slightly more elaborate sub-embodiment, a metal member is comprised of an arrangement of at least two types of wires into an assembly, and a plurality of these metal members (assemblies of wires) are jacketed to form a composite which is then drawn, stripped of its cladding, and heated to conversion to alloy.

Figure 17:
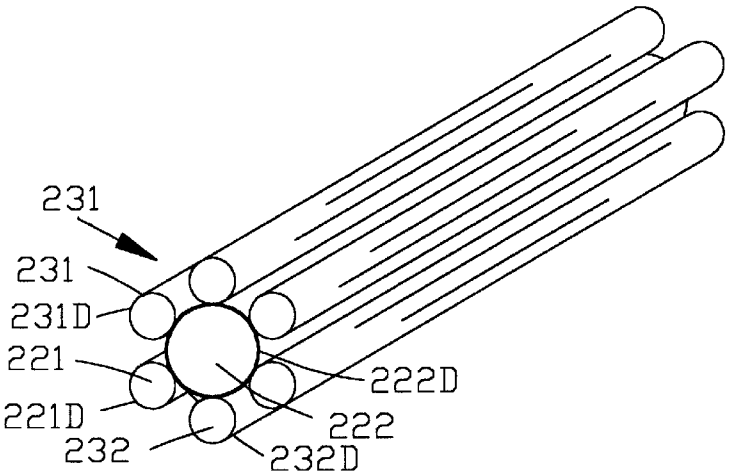
FIG. 17 is an isometric view of an assembly (metal member) of first and second plurality of coated wires.
Figure 17A:
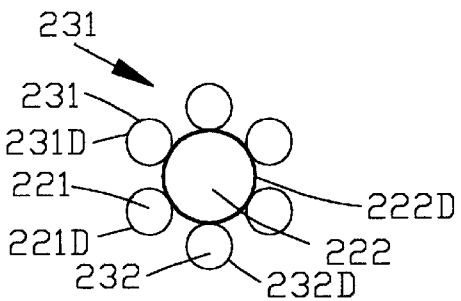
FIG. 17A is an end view of FIG. 17.
Figure 16:
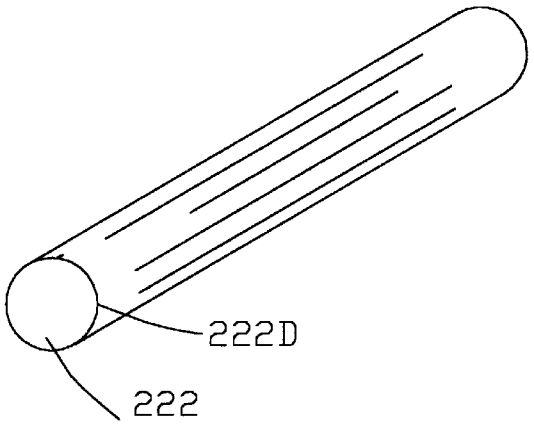
FIG. 16 is an isometric view of a first metallic wire.
Figure 16A:
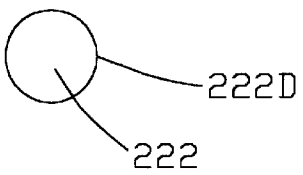
FIG. 16A is an end view of FIG. 16.

FIG. 16 is an isometric view of a first metallic wire 222 with a diameter 222. FIG. 16A is an end view of FIG. 16. FIG. 17 is an isometric view of the first metallic wire 222 and a plurality of second metallic wires 221 which are assembled to form an assembled metallic member 231. The assembly metal member 231 comprises a arrangement of the first and second metallic wires 221 and 222. In the example, each of the plurality of first metallic wires 221 has first diameter 221D whereas the second metallic wire 222 has second diameter 222D. In the illustrated embodiment, the first diameter 221D of the first metallic wire 221 is smaller in diameter relative to the second diameter 222D of the second metallic wire 222. As will be described in greater detail hereinafter, the assembly metal member 231 may be formed in various ways. FIG. 17A is a cross sectional view of FIG. 17.

In a preferred embodiment, the first and second wires have the same diameter, and the metal members are comprised of nickel and aluminum in a ratio of six nickel wires to one aluminum wire. In another embodiment, the metal members are comprised of nickel and aluminum wires in a ratio of five nickel to two aluminum wires.

FIG. 1 illustrates the process step 12 of cladding an array of assemblies or metal members within the tube to form the metal composite or cladding.

Figure 18:
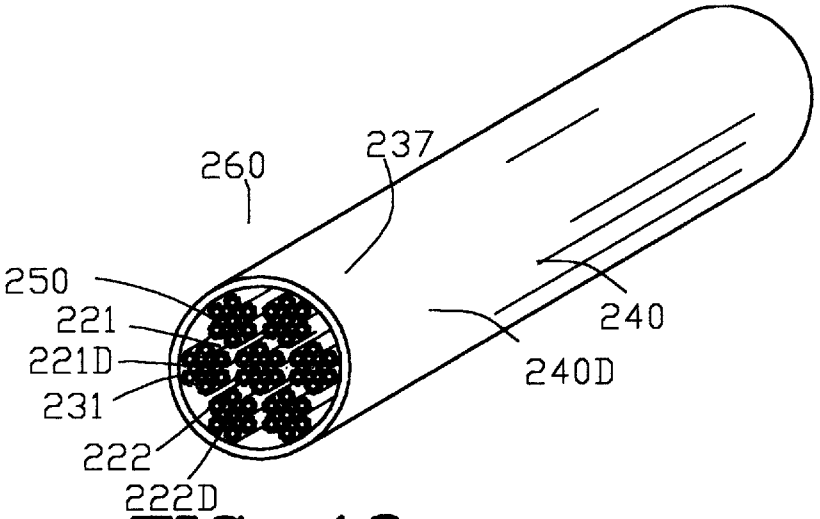
FIG. 18 is an isometric view of a jacketed array of the assemblies or metal members comprised of the first and second wires of FIG. 17.
Figure 18A:
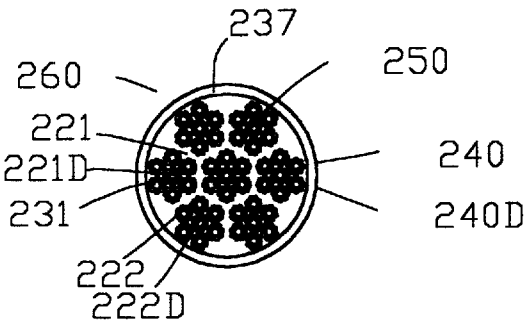
FIG. 18A is a cross sectional view of the metal composite or cladding of FIG. 18.

FIG. 18 is an isometric view of a jacketed array 250 of the assemblies or metal members 231 comprised of the first and second wires 221 and 222 of FIG. 16. FIG. 18A is a cross sectional view of the metal composite or cladding of FIG. 18. The composite cladding tube 240 has a diameter 240D. The composite cladding tube 240 can act as a heat sink to protect the array 250 of member assemblies 231 of the first and second plurality of (coated) wires 221 and 222 from the heat of the drawing process, thereby preventing premature alloy formation. Where the wires are jacketed prior to being arranged into the assembly metal members, the wire tubing material 230A, 230B is preferably of the same material as the composite cladding tubing 240.

Preferably, the composite cladding tube 240 is a carbon steel material with the plurality of first and second metallic wires 221 and 222 being made of nickel and aluminum. Preferably, approximately one thousand (1000) of the first and second metallic wires 221 and 222 are encased within the casing 234.

In a preferred embodiment, the metal members comprised of the arrangement of metal wires can be drawn and then jacketed with a tubing prior to being jacketed with a composite tube to form a metal composite.

Figure 19:
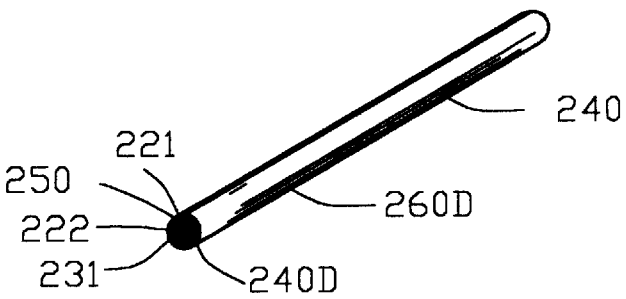
FIG. 19 is an isometric view of the metal composite of FIG. 18 after a first drawing process.
Figure 19A:
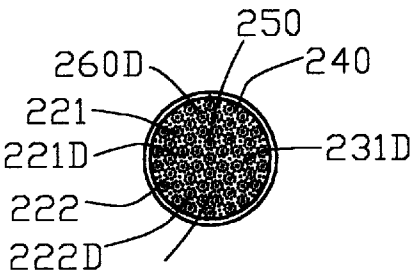
FIG. 19A is an end view of FIG. 19.

FIG. 1 illustrates the process step 13 of drawing the metal composite to reduce the diameter thereof. FIG. 19 is an isometric view of the metal composite of FIG. 18 after a first drawing process 13. The composite may be drawn more than once. FIG. 19A is an end view of FIG. 19. The process step 13 of drawing the metal composite 260 provides three effects. Firstly, the drawing step 13 reduces the outer diameter 260D of the composite 260. Secondly, the drawing step 13 reduces the corresponding outer diameter 221D and 222D of each of the first and second plurality of metallic wires 221 and 222 and, when coated, the corresponding outer diameter 230A-D and 330B-D of each of the coating materials 230A and 230B. Thirdly, the heat generated in the drawing step 13 can cause the adjacent like wires within a metal member to diffusion weld and the like wires of adjacent metal members to become continuous. This is the case where the wires are comprised of nickel, or are comprised of aluminum.

FIG. 1 illustrates the process step 14 of removing the composite tube to leave a remainder. Preferably, the step 14 of removing the tube comprises mechanically removing the tube.

Figure 20:
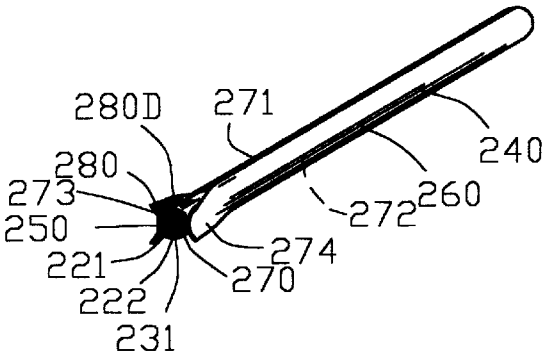
FIG. 20 is an isometric view illustrating the mechanical removal of the composite tube.
Figure 20A:
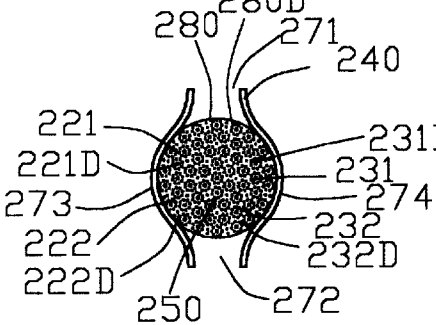
FIG. 20A is an enlarged cross sectional view of FIG. 20.

FIG. 20 is an isometric view illustrating the mechanical removal of the composite tube 240 with FIG. 20A being an enlarged cross sectional view of FIG. 20. In one example of this process step, the tube 240 is scored or cut at 271 and 272 by mechanical scorers or cutters (not shown). The scores or cuts at 271 and 272 form tube portions 273 and 274 that are mechanically pulled apart to peel the tube 240 off of a remainder 280. The remainder 280 comprises a substantially unitary material 270 with the first and second plurality of metallic wires 221 and 222 contained therein. The remainder 280 defines an outer diameter 280D.

FIG. 1 illustrates the process step 15 of heating the composite minus the composite tubing to convert the remainder to alloy. In the preferred form of the process, the remainder is heated to a temperature in the range of 1000° C.–1300° C. step 15 so as to convert the metal remainder to an alloy.

Figure 21:
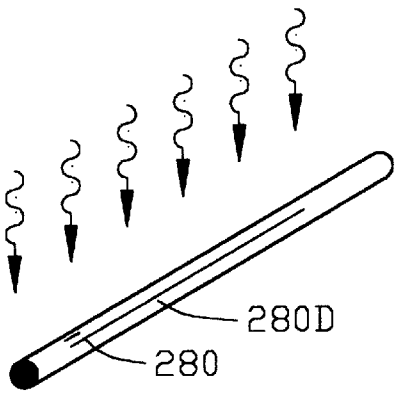
FIG. 21 is an isometric view illustrating the remainder upon complete removal of the tube.

FIG. 21 is an isometric view illustrating the remainder 280 upon complete removal of the tube 240. The remainder 280 comprises substantially continuous metal phase of metal wire 221 material with metal mire 222 dispersed throughout. The remainder 280 defines an outer diameter 280D. The spiraling arrows in FIG. 21 represent the general application of heat to the remainder 280. As heat is applied to the remainder 280, the metals in each metal member 231 (from the metal wires 220, 222) combine to form a new metal alloy 290.

Figure 21A:
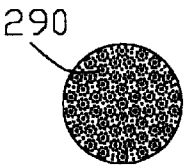
FIG. 21A is an enlarged cross sectional view of FIG. 21 after heating, showing the alloy product of the heated remainder of FIG. 21.

FIG. 21A is an enlarged cross sectional view of FIG. 21 after heating, showing the alloy product 290 of the heated remainder 280 of FIG. 21. The alloy 290 product is comprised of a single wire. The wire has a number of randomly oriented pores which presumable form due to the difference in density of the product and the pre-alloy metals. The product has a high ductility.

In a preferred embodiment, the alloy is $Ni_3Al$. In this embodiment, the metal wire diameter and composite tubing thickness (one comprised of nickel and the other of aluminum) are chosen so that the final product contains seventy-five atomic percent Ni and twenty-five atomic percent Al. The reactants must have roughly 86.7% by weight nickel and 13.3% by weight aluminum.

In another embodiment, the alloy product is NiAl. In this embodiment, the metal wire diameter and composite tubing thickness are chosen so that the final product contains fifty atomic percent Ni and fifty atomic percent Al. Where the diameter of the aluminum and nickel (first and second) wires is the same, the ration of nickel wires to aluminum wires in a given metal member is 5:2.

In yet another embodiment, the alloy product is Fe3Al. The metal wire diameter and composite tubing thickness (one comprised of iron and the other of aluminum) are chosen so that the final product contains seventy-five atomic percent Fe and twenty-five atomic percent Al.

In another embodiment, the alloy product is FeAl. In this embodiment, the metal wire diameter and composite tubing thickness are chosen so that the final product contains fifty atomic percent Fe and fifty atomic percent Al.

Figure 22:
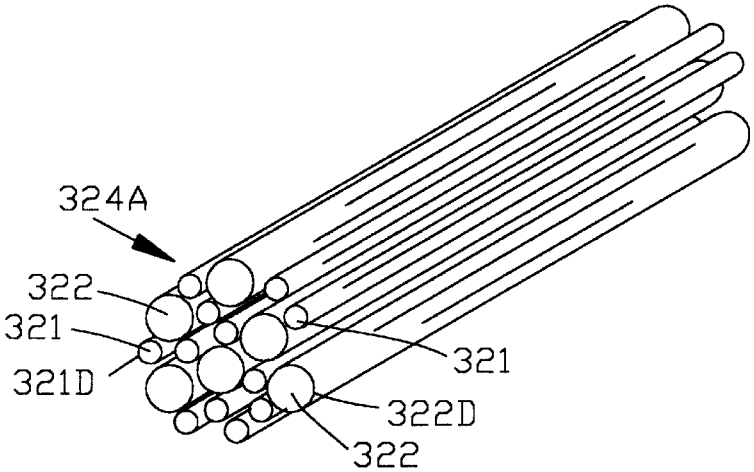
FIG. 22 is an isometric view of another example of an assembly metal member comprised of a plurality of first and second metallic wires.

FIG. 22 is an isometric view of another example of an assembly metal member comprised of a plurality of first and second metallic wires 421 and 422. The first metallic wires 421 have a first diameter 421D whereas the second metallic wires 422 have a second diameter 422D. In addition, the first metallic wires may be of a different composition than the second metallic wire 422. The first and second metallic wires 421 and 422 form a mixed assembly suitable for use as the assembly members 431 set forth in FIGS. 18–21. In this example, the first and second metallic wires 421 and 422 are randomly located within the assembly metal member 431.

Figure 23:
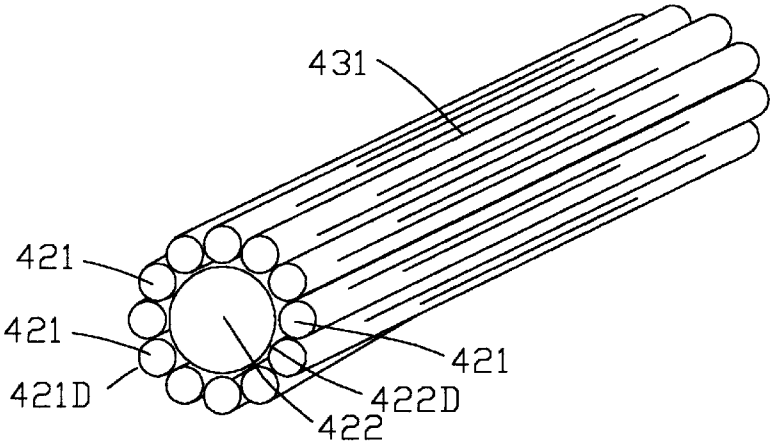
FIG. 23 is an isometric view of another example of an assembly member of a plurality of first and second metallic wires.

FIG. 23 is an isometric view of another example of an assembly member 531 of a plurality of first and second metallic wires 521 and 522. As shown, the first metallic wires 521 have a first diameter 521D whereas the second metallic wires 522 have a second diameter 522D. In this example, the ratio of the first and second metallic wires 521 and 522 is altered relative to the assembly of FIG. 18.

Figure 24:
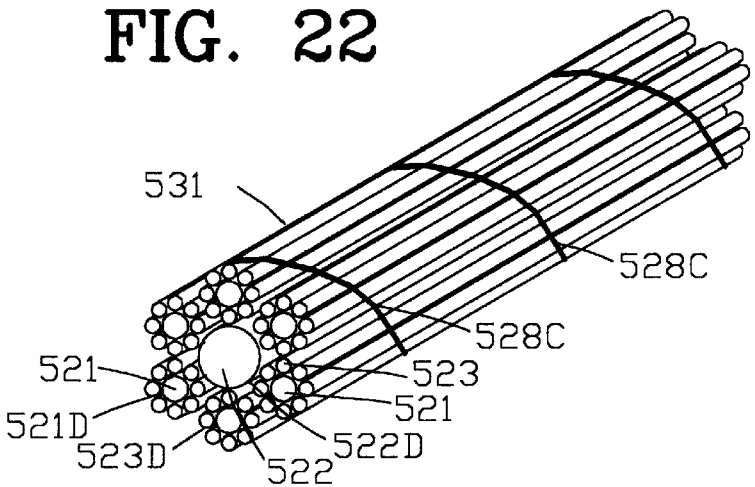
FIG. 24 is an isometric view of a plurality of arranged wires that have been twisted so as to form a twisted metal member.

In addition, the plurality of first and second and third metallic wires 621,622, 623 can be twisted to form a twisted assembly metal member 631 (FIG. 24). A plurality of these twisted assembly metal members are assembled into an array for cladding into a composite tube to form a metal composite. This twisting can be performed on any of the aforementioned assembly metal members. Preferably, the first, second, and third metallic wires 621, 622, and 623 are twisted into a helical pattern to provide the metal member 631 at the rate of 1.5 turns per 2.5 centimeters. The metal members may be coiled for on a spool (not shown) for temporary storage.

Figure 25:
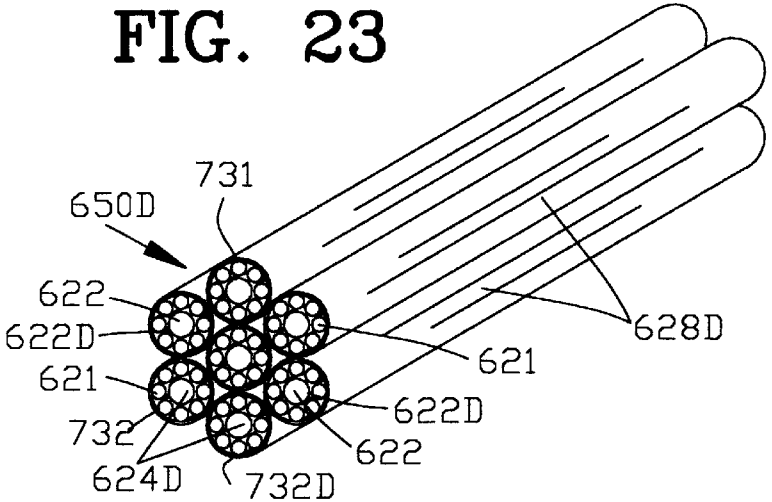
FIG. 25 is an isometric view of another example of an arrangement of first and second wires into a metal member wherein each metal member is jacketed in a tubing and a plurality of jacketed metal members will then be jacketed in a composite tubing to comprise the metal composite.

FIG. 25 is an isometric view of another example of an arrangement of first and second wires into a metal member. In this example of an array, each metal member 731 is jacketed in a tubing 732, and a plurality of jacketed metal members 731 will then be jacketed in a composite tubing to comprise the metal composite. Preferably the tubing 732 that jackets each individual metal member 731 and the composite tubing (not shown) are comprised of the same metal, most preferably carbon steel. When the composite tubing is removed (mechanically or chemically), the tubings surrounding the first and second wires are either contemporaneously or separately removed (chemically) to leave a remainder 780. Once heated, the remainder converts to a fibrous alloy product 790. Again, some of the preferred alloy products include $Ni_3Al$, NiAl, $Fe_3Al$, and FeAl. Other metal wires can be used to produce other wire alloy products. Any number of the metal wires can be alloy.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A process for making an alloy comprising:

a. cladding with a tube a plurality of metal wire members including a first and a second metal to form a metal composite;

b. drawing the metal composite for reducing the diameter thereof;

c. removing the tube so as to provide a remainder; and d. heating the remainder to a temperature sufficient to convert the first metal and the second metal within the remainder to form the alloy from the first metal and the second metal.

2. The process for making an alloy as defined in claim 1, further comprising providing a plurality of first and second metal members comprised of first and second metals respectively and twisting the plurality of metal members into a twisted assembly, and cladding with a composite tube a plurality of the twisted assemblies so as to form the metal composite of step (a).

3. The process for making an alloy as defined in claim 1, wherein the plurality of metal members is comprised of nickel and aluminum, and wherein each individual metal member is comprised of either nickel or aluminum.

4. The process for making an alloy as defined in claim 3, wherein the nickel to aluminum ratio in atoms is 3 to 1.

5. The process for making an alloy as defined in claim 1, wherein the plurality of metal members is comprised of at least three metals, and wherein each individual member is comprised of a single metal.

6. The process for making an alloy as defined in claim 5, wherein the plurality of metal members is comprised of aluminum and nickel, and wherein the plurality of metal members further comprises at least one of the metals selected from the group consisting of Ti and Fe.

7. The process for making an alloy as defined in claim 1, wherein the tube cladding the plurality of metal members is comprised of carbon steel.

8. The process for making an alloy as defined in claim 1, further including the step of cladding a plurality of metal wires comprised of a first metal with a plurality of second tubings comprised of a second metal by placing a tubing on each metal wire to form the plurality of metal members of step (a).

9. The process for making an alloy as defined in claim 8, further comprising drawing the plurality of metal members to reduce the diameter thereof prior to cladding the metal members to form the metal composite.

10. The process for making an alloy as defined in claim 8, wherein either one of the metal rod members or the metal member second tubing is comprised of Ni and wherein the other is comprised of Al.

11. The process for making an alloy as defined in claim 1, further including the steps of cladding a plurality of metal wires comprised of a first metal with a plurality of second tubings comprised of a second metal by placing a tubing to form a plurality of metal members;

cladding the metal members with a third tubing to form a plurality of coated metal members;

drawing the coated metal members to reduce the diameter thereof;

cladding with a tube the plurality of coated metal members with the tube of step (a) to form the metal composite of step (a); and removing the third tubing in step (c) as well as the outer tube of the metal composite to provide the metallic remainder.

12. A process for making an alloy comprising:

a. cladding a plurality of metal wires comprised of a first metal with a plurality of first tubings comprised of a second metal to form a plurality of metal members;

b. cladding the plurality of metal members with a second tubing to provide a metal composite;

c. drawing the metal composite to reduce the diameter thereof to provide a drawn metal composite;

d. removing the second tubing to provide a metal remainder comprising the metal first tubing cladding material with the metal wire material contained therein; and e. heating the remainder to a temperature sufficient to convert the first metal and the second metal within the remainder to form the alloy from the first metal and the second metal.

13. The process for making an alloy as defined in claim 12, wherein the drawn metal composite is heated subsequent to removing the second tubing.

14. The process for making an alloy as defined in claim 12, wherein either the metal wires or the metal member first tubings are comprised of Ni and wherein the other is comprised of Al.

15. The process for making an alloy as defined in claim 13, wherein the second tubing is comprised of carbon steel.

16. The process for making an alloy as defined in making an alloy as defined in claim 12, including the step of cladding each metal member with a third tubing to form a plurality of coated metal members;

drawing the coated metal members to reduce the diameter thereof; cladding the plurality of coated metal members with the second tubing of step (b) to form the metal composite of step (b); and additionally removing the third tubing along with the second tubing in step (d) to provide the metallic remainder.

17. The process for making an alloy as defined in claim 16, wherein said metal remainder is in fibrous form.

18. A process for making an alloy comprising:

a. cladding a plurality of metal wires comprised of a first metal with a plurality of first tubings comprised of a second metal to form a plurality of metal members;

b. cladding each metal member with a second tubing to form a plurality of coated metal members;

c. drawing the coated metal members to reduce the diameter thereof;

d. cladding the plurality of coated metal members with a third tubing to provide a metal composite;

e. drawing the metal composite to reduce the diameter thereof;

f. removing the second and third tubings to provide a metallic remainder comprising the metallic first tubing cladding material with the metallic wire material; and heating the remainder to a temperature sufficient to convert the first metal and the second metal within the remainder to form the alloy from the first metal and the second metal.

* * * * *